US011577139B1

(12) United States Patent
Campbell et al.

(10) Patent No.: US 11,577,139 B1
(45) Date of Patent: Feb. 14, 2023

(54) BASKETBALL TRAINING SYSTEM

(71) Applicant: Airborne Athletics, Inc., Bloomington, MN (US)

(72) Inventors: Douglas B. Campbell, Loretto, MN (US); Jeffrey J. Campbell, Lonsdale, MN (US); Adam T. Pan, Lonsdale, MN (US)

(73) Assignee: Airborne Athletics, Inc., Bloomington, MN (US)

( * ) Notice: Subject to any disclaimer, the term of this patent is extended or adjusted under 35 U.S.C. 154(b) by 718 days.

(21) Appl. No.: 15/713,202

(22) Filed: Sep. 22, 2017

Related U.S. Application Data

(60) Provisional application No. 62/419,177, filed on Nov. 8, 2016, provisional application No. 62/402,417, filed on Sep. 30, 2016.

(51) Int. Cl.
*A63B 69/00* (2006.01)
*A63B 69/40* (2006.01)

(52) U.S. Cl.
CPC ..... *A63B 69/0071* (2013.01); *A63B 69/407* (2013.01); *A63B 2225/50* (2013.01); *A63B 2243/0037* (2013.01)

(58) Field of Classification Search
CPC . A63B 69/0071; A63B 69/407; A63B 63/083; A63B 2063/001; A63B 24/0021; A63B 71/0622; A63B 2220/17; A63B 2220/805; A63B 2225/50
See application file for complete search history.

(56) References Cited

U.S. PATENT DOCUMENTS

| | | | |
|---|---|---|---|
| 1,223,386 | A | 4/1917 | Handelan |
| 2,908,266 | A | 10/1959 | Cooper |
| 3,776,550 | A | 12/1973 | McNabb |
| 3,802,703 | A | 4/1974 | Van Tassel |
| 3,878,828 | A | 4/1975 | Francesco |
| 4,168,695 | A | 9/1979 | Haller et al. |
| 4,262,648 | A | 4/1981 | Wegener et al. |
| 4,471,746 | A | 9/1984 | Ando |
| 4,517,953 | A | 5/1985 | Osaka et al. |
| 4,579,340 | A | 4/1986 | Jenkins et al. |
| 4,667,957 | A | 5/1987 | Joseph |

(Continued)

FOREIGN PATENT DOCUMENTS

WO WO1995032033 11/1995

OTHER PUBLICATIONS

Airborne Athletics, Inc. 1 page advertising brochure, © Airborne Athletics, Inc., before 2012, 1 page.

(Continued)

*Primary Examiner* — Melba Bumgarner
*Assistant Examiner* — Amir A Klayman
(74) *Attorney, Agent, or Firm* — Fish & Richardson P.C.

(57) ABSTRACT

A basketball training system includes a user interface and a ball delivery machine. The user interface presents a visual representation of a portion of a basketball court that is free of indicia representing predetermined ball delivery locations on the basketball court. The user interface receives user inputs relative to the visual representation that identify selected ball delivery locations desired by the user. The ball delivery machine is responsive to the user interface for delivering basketballs to the selected ball delivery locations.

26 Claims, 7 Drawing Sheets

(56) References Cited

U.S. PATENT DOCUMENTS 4,678,189 A 7/1987 Koss
4,714,248 A 12/1987 Koss
4,882,676 A 11/1989 Van De Kop et al.
4,913,431 A 4/1990 Jakobs
4,915,384 A 4/1990 Bear
4,936,577 A 6/1990 Kington et al.
4,940,231 A 7/1990 Ehler
4,955,605 A 9/1990 Goldfarb
5,016,875 A 5/1991 Joseph
5,125,651 A 6/1992 Keeling et al.
5,183,253 A 2/1993 Grimaldi et al.
5,312,099 A 5/1994 Oliver, Sr.
5,365,427 A 11/1994 Soignet et al.
5,393,049 A 2/1995 Nelson
5,409,211 A 4/1995 Adamek
5,417,196 A 5/1995 Morrison et al.
5,540,428 A 7/1996 Joseph
5,601,284 A 2/1997 Blackwell et al.
5,692,978 A 2/1997 Hummel
5,676,120 A 10/1997 Joseph
5,681,230 A 10/1997 Krings
5,746,668 A 5/1998 Ochs
5,771,018 A 6/1998 Kennedy
5,776,018 A * 7/1998 Simpson ..... A63B 24/0021 473/433
5,813,926 A 9/1998 Vance
5,816,953 A 10/1998 Cleveland
5,842,699 A 12/1998 Mirando et al.
5,937,143 A 8/1999 Watanabe
5,980,399 A 11/1999 Campbell et al.
6,167,328 A 12/2000 Takaoka
6,224,503 B1 5/2001 Joseph
6,241,628 B1 * 6/2001 Jenkins ..... A63B 69/0071 124/6
6,280,352 B1 * 8/2001 Coffeen ..... A63B 24/0021 434/248
6,302,811 B1 10/2001 Topham
6,389,368 B1 5/2002 Hampton
6,458,049 B2 10/2002 Bush
6,659,893 B1 12/2003 Campbell et al.
6,707,487 B1 * 3/2004 Aman ..... A63B 24/0003 348/169
6,918,591 B2 7/2005 D'Amico et al.
7,056,237 B2 6/2006 Slavey et al.
7,066,845 B2 6/2006 Joseph
7,288,034 B2 10/2007 Woodard et al.
7,620,466 B2 11/2009 Neale et al.
7,641,574 B2 1/2010 Steen
7,927,237 B2 * 4/2011 Jenkins ..... A63B 69/0071 473/431
7,945,349 B2 5/2011 Svensson
7,970,492 B2 6/2011 Matsushima
8,012,046 B2 9/2011 Campbell et al.
8,123,634 B1 * 2/2012 Lovett ..... A63B 63/083 473/433
8,147,356 B2 4/2012 Campbell et al.
8,301,277 B2 * 10/2012 Jones ..... A63B 24/0021 700/91
8,617,008 B2 * 12/2013 Marty ..... G06T 7/70 273/317
8,727,784 B1 * 5/2014 Wolf ..... G09B 19/22 434/248
8,845,460 B1 9/2014 Feldstein
8,852,030 B2 10/2014 Campbell et al.
8,911,308 B2 * 12/2014 Daniels ..... A63B 69/00 473/439
9,017,188 B2 * 4/2015 Joseph ..... A63B 24/0075
D739,488 S 9/2015 Campbell et al.
9,199,150 B2 * 12/2015 Wackerly ..... A63B 69/0071
9,444,306 B2 * 9/2016 Bradfield ..... H02K 23/10
9,452,339 B1 * 9/2016 Shah ..... F41B 4/00
9,569,005 B2 * 2/2017 Ahmed ..... G06F 3/017
9,600,716 B2 3/2017 Skjaerseth et al.
9,724,584 B1 8/2017 Campbell et al.
9,808,696 B2 11/2017 Campbell et al.
9,975,026 B2 5/2018 Campbell et al.
10,004,949 B2 6/2018 Brothers et al.
10,192,360 B2 1/2019 Osawa et al.
10,503,965 B2 12/2019 Smith
10,596,436 B1 * 3/2020 Campbell ..... A63B 69/0071
10,639,531 B1 5/2020 Mccarter
10,643,492 B2 * 5/2020 Lee ..... G06V 40/23
10,688,362 B1 6/2020 Sangalang
10,861,200 B1 12/2020 Graham
11,045,705 B2 6/2021 Zhang
11,247,109 B1 * 2/2022 Campbell ..... A63B 71/02
2003/0073518 A1 4/2003 Marty et al.
2003/0224337 A1 * 12/2003 Shum ..... A63B 24/00 434/247
2005/0085320 A1 4/2005 Joseph et al.
2005/0187036 A1 8/2005 Ziola et al.
2005/0215870 A1 9/2005 Rademaker
2006/0057549 A1 3/2006 Prinzel, III et al.
2006/0138809 A1 6/2006 Joseph
2006/0160639 A1 7/2006 Klein
2006/0236993 A1 10/2006 Cucjen et al.
2007/0026974 A1 2/2007 Marty et al.
2007/0265138 A1 11/2007 Ashby
2008/0015061 A1 * 1/2008 Klein ..... A63B 69/0071 473/447
2008/0171620 A1 7/2008 Feldmeier
2008/0254866 A1 10/2008 Young et al.
2008/0261726 A1 * 10/2008 Chipperfield ..... A63B 24/0021 473/434
2009/0047645 A1 2/2009 Dibenedetto et al.
2009/0137347 A1 5/2009 Jenkins et al.
2009/0191988 A1 7/2009 Klein
2009/0270743 A1 10/2009 Dugan et al.
2009/0325739 A1 * 12/2009 Gold ..... A63B 43/00 473/570
2010/0259412 A1 10/2010 Pagonakis
2010/0261557 A1 10/2010 Joseph et al.
2010/0292033 A1 11/2010 Sarver
2011/0084925 A1 4/2011 Baik
2011/0205111 A1 8/2011 Balardeta et al.
2012/0142454 A1 6/2012 Campbell et al.
2012/0309551 A1 12/2012 Holzhacker
2012/0322587 A1 12/2012 Duke
2013/0005512 A1 1/2013 Joseph et al.
2013/0157786 A1 6/2013 Joseph et al.
2014/0045166 A1 2/2014 Coleman
2014/0081436 A1 * 3/2014 Crowley ..... A63B 24/0062 700/91
2014/0222177 A1 * 8/2014 Thurman ..... G09B 19/0038 700/92
2014/0244012 A1 8/2014 Doherty et al.
2014/0305420 A1 * 10/2014 Deese ..... A63B 69/406 124/78
2014/0336796 A1 * 11/2014 Agnew ..... G09B 5/06 700/91
2014/0340329 A1 11/2014 Chen
2014/0371885 A1 * 12/2014 Ianni ..... G06K 9/00342 700/91
2015/0131845 A1 * 5/2015 Forouhar ..... G06K 9/00724 382/100
2015/0238819 A1 8/2015 Volkerink et al.
2015/0306455 A1 10/2015 Decarlo
2015/0352425 A1 * 12/2015 Lewis ..... A63B 71/0619 124/78
2016/0001136 A1 * 1/2016 King ..... A63B 69/0071 320/108
2016/0098941 A1 * 4/2016 Kerluke ..... G09B 19/0038 700/91
2016/0250540 A1 * 9/2016 Joseph ..... A63B 24/0075 473/433
2016/0325166 A1 11/2016 Wallace
2016/0332054 A1 11/2016 Smith
2017/0232298 A1 8/2017 Joseph et al.
2017/0340943 A1 11/2017 Pierotti et al.
2017/0354845 A1 * 12/2017 Williams ..... A63B 71/0622
2018/0139425 A1 * 5/2018 Mutter ..... G06T 3/0093
2018/0154212 A1 6/2018 Park et al.

(56) References Cited

U.S. PATENT DOCUMENTS

| | | | | |
|---|---|---|---|---|
| 2018/0290019 | A1 | 10/2018 | Rahimi et al. | |
| 2020/0009443 | A1* | 1/2020 | Moravchik | G06K 9/00201 |
| 2020/0047049 | A1* | 2/2020 | Ahmed | A63C 19/062 |
| 2020/0114243 | A1 | 4/2020 | Janssen | |
| 2020/0179755 | A1* | 6/2020 | Ristas | A63B 24/0087 |
| 2020/0193863 | A1 | 6/2020 | Smith | |
| 2021/0008433 | A1 | 1/2021 | Bush | |
| 2021/0052961 | A1 | 2/2021 | Brody | |
| 2021/0064880 | A1 | 3/2021 | Zhang et al. | |
| 2021/0128977 | A1* | 5/2021 | Picker | G06F 1/163 |
| 2021/0286423 | A1 | 9/2021 | Correia | |
| 2021/0370152 | A1 | 12/2021 | Gordon | |

OTHER PUBLICATIONS

Airborne Athletics, Inc., "Dr. Dish Owner's Manual," Oct. 2005, 31 pages.

Brochure entitled "The All New 8000 Series Gun," by Shoot-A-Way before Oct. 12, 2011, 12 pages.

Brochure entitled "The Shoot Away: The perfect Shooting Aid," before Dec. 2, 2011, 1 page.

Reich et al., "A spatial analysis of basketball shot chart data," The American Statistician, Feb. 2006, 60(1):3-12.

Sniper, "Sniper Program Instructions Help with F1," Feb. 10, 1995, 18 pages.

Sniper, "Sniper the Ultimate Basketball Trainer," before Oct. 1995, 4 pages.

* cited by examiner

BASKETBALL TRAINING SYSTEM

CROSS-REFERENCE TO RELATED APPLICATION

This application claims priority to U.S. Provisional Application No. 62/402,417 filed on Sep. 30, 2016, and entitled "BASKETBALL TRAINING SYSTEM," the contents of which are hereby incorporated by reference in their entirety. This application also claims priority to U.S. Provisional Application No. 62/419,177 filed on Nov. 8, 2016, and entitled "BASKETBALL TRAINING SYSTEM," the contents of which are hereby incorporated by reference in their entirety.

BACKGROUND

This disclosure relates generally to sports training, and in particular to basketball return systems with a user interface.

Training in sports involves the development of skills as well as physical conditioning. The game of basketball requires physical strength and conditioning, and also requires special skills. Successful development of those skills requires repetition during practice.

Although it is a team sport, basketball presents opportunities for an individual player to practice and improve his or her game without the need for other players to be present. A player can develop ball handling skills and shooting skills through individual practice.

Basketball players develop their shooting skills by shooting the basketball from various locations on the court. If a second player is not present to rebound, the shooter must rebound his or her own shots. The rebounding process can waste time that could otherwise be used in taking more shots. Over the past several decades, a number of ball collecting devices have been developed to collect basketballs shot at the basketball goal (i.e. the backboard and the attached hoop). The ball collecting devices generally include netting and a frame for supporting the netting around the basketball goal. The ball collecting devices are often used with a ball delivery device, which directs the ball back to the player.

Motorized ball delivery devices can return basketballs to a shooter at various locations on a basketball court. The ball delivery device can have programs that determine which direction to return balls to the player, how many times to return the ball, etc.

Successful shooting of a basketball can be affected by a number of factors, including a player's form or technique in shooting. In some cases, poor form or technique may have less effect when the player is taking uncontested shots from similar distances, but may limit the player's ability to score in game conditions when the player is guarded by another player and often must attempt shots from varying positions on the court having varying distances from the basketball goal.

As players advance in skill and experience, they are often confronted with the realization that the speed of the game gets "faster," and that he or she will need to consistently score under increasing pressure and from various positions on the court. Continuing to practice under conditions that do not effectively simulate the level of movement required of the shooter and the variety of shot locations frequently encountered in game conditions can result in some improvement in the player's shooting, but may ultimately limit the player's success as the player rises through the levels of play from, e.g., junior varsity to varsity, from high school varsity to college, and from college to professional basketball.

SUMMARY

In one example, a basketball training system includes a user interface that presents a visual representation of a portion of a basketball court that is free of indicia representing predetermined ball delivery locations on the basketball court. The user interface receives user inputs relative to the visual representation that identify selected ball delivery locations desired by the user. The basketball training system further includes a ball delivery machine, responsive to the user interface, for delivering basketballs to the selected ball delivery locations.

In another example, a method includes outputting, by a computing device for presentation at a display device, a user interface including a visual representation of at least a portion of a basketball court that is free of indicia representing predetermined ball delivery locations on the basketball court. The method further includes receiving, by the computing device, an indication of user inputs relative to the visual representation that identify selected ball delivery locations, and outputting, by the computing device, the selected ball delivery locations to a controller of a ball delivery machine configured to deliver basketballs to the selected ball delivery locations.

DETAILED DESCRIPTION

Figure 1:
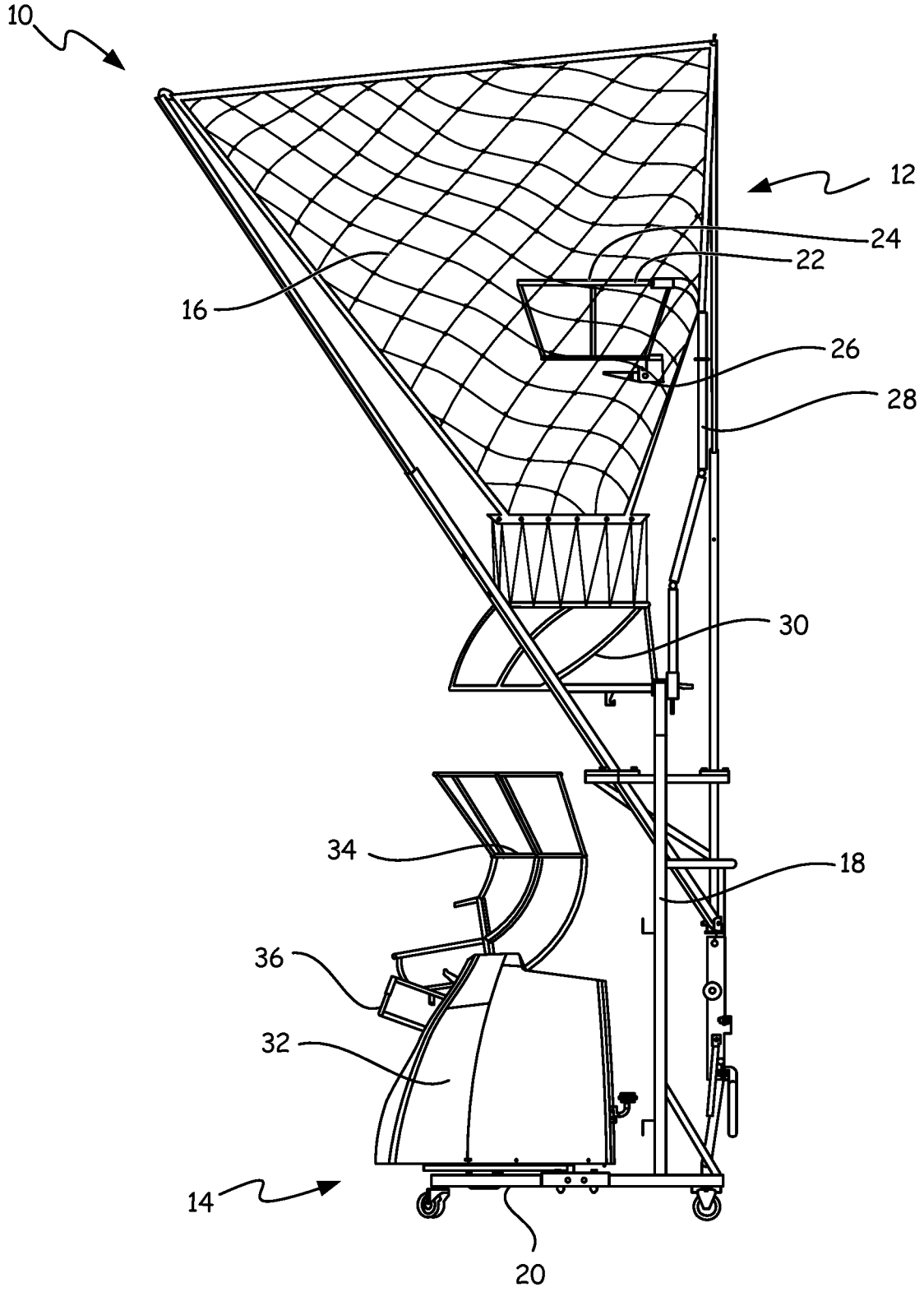
FIG. 1 is a side view of a basketball training machine that includes a ball collection system and a ball delivery system responsive to a user interface that receives input to identify selected ball delivery locations.

FIG. 1 shows a side view of basketball training machine 10. Basketball training machine 10 includes two main systems, ball collection system 12 and ball delivery system 14. Further description of basketball training machine 10 can be found in currently-pending patent application Ser. No. 15/148,596, filed on May 6, 2016 and entitled BASKETBALL TRAINING SYSTEM.

Ball collection system 12 includes net 16, net frame 18, base 20, shots made counter 22 (which, in this embodiment, includes made shots funnel 24, shots made sensor 26, and counter support frame 28), and upper ball feeder 30. When machine 10 is used for shooting practice, net 16 is positioned in front of a basketball backboard (not shown) so that the basketball hoop and net (not shown) are immediately above shots made counter 22. The size of net 16 is large enough so that missed shots (which do not go through the basketball hoop and net and through shots made counter 22) will still be collected by net 16 and funneled down to upper ball feeder 30.

Ball delivery system 14 includes ball delivery machine 32, main ball feeder 34, and ball ready holder 36. The inlet of main ball feeder 34 is positioned immediately below the outlet of upper ball feeder 30. Ball delivery machine 32 is pivotally mounted on base 20. Ball delivery machine 32 is pivotable about an axis that is aligned with the inlet of main ball feeder 34 and the outlet of upper ball feeder 30. Balls drop out of upper ball feeder 30 into main ball feeder 34. Balls are delivered one at a time from main ball feeder 34 into ball ready holder 36 at the front of ball delivery machine 32. Launch arm 38 (shown in FIG. 2) launches the basketball out of holder 36 to a location on the floor where the player catches the ball and shoots. The location on the floor where the ball is delivered can be changed by pivoting machine 32 with respect to base 20.

As is further described below, ball delivery system 14 is responsive to a user interface that receives user input to identify selected ball delivery locations desired by a user. The user interface presents a visual representation of at least a portion of a basketball court that is free of indicia representing predetermined ball delivery locations on the basketball court, such as visual markings, buttons, lights, or other physical or graphically-rendered indications of predetermined ball delivery (or shot) locations. The user interface is configured to receive inputs (e.g., gesture input at a touch-sensitive and/or presence-sensitive device, input from a mouse, keyboard, voice command, or other input) relative to the visual representation of the basketball court that identify the selected ball delivery locations. A control system (shown in FIG. 4) of ball delivery system 14 provides control commands to ball delivery machine 32 to cause ball delivery machine 32 to launch basketballs in directions based upon the selected ball delivery locations. In certain examples, the control system provides control commands to ball delivery machine 32 to cause ball delivery machine 32 to launch basketballs at a ball delivery speed that is determined (e.g., automatically determined by the control system) based on a distance between ball delivery machine 32 and the selected ball delivery location. The control system, in some examples, provides control commands to ball delivery machine 32 to cause ball delivery machine 32 to adjust a trajectory of the delivered balls as they exit ball delivery machine 32 to enable effective ball delivery to locations at both shorter and longer distances from ball delivery machine 32, to enable varying types of passes (e.g., bounce passes, chest passes, lob passes, or other types of passes), and/or to accommodate for player height. As such, ball delivery system 14, responsive to the user interface, enables a user (e.g., a player, coach, or other user) to select desired ball delivery locations relative to the visual representation of the basketball court that are not limited by indications of predetermined ball delivery locations. In this way, ball delivery system 14 allows a greater range of selected ball delivery locations that can allow a user to better simulate game-like conditions that include multiple ball delivery locations at varying distances from the basketball goal, thereby increasing an effectiveness of the training system to prepare the player for such game conditions. While described herein with respect to basketball training machine 10, it should be understood that aspects of basketball training machine 10 can be applied to other ball sports as well. For instance, basketball training machine 10 can deliver volleyballs, soccer balls, or other types of balls for training purposes for such other sports. As such, basketball training machine 10 can be considered, in some examples, as a ball sports training machine.

Figure 2:
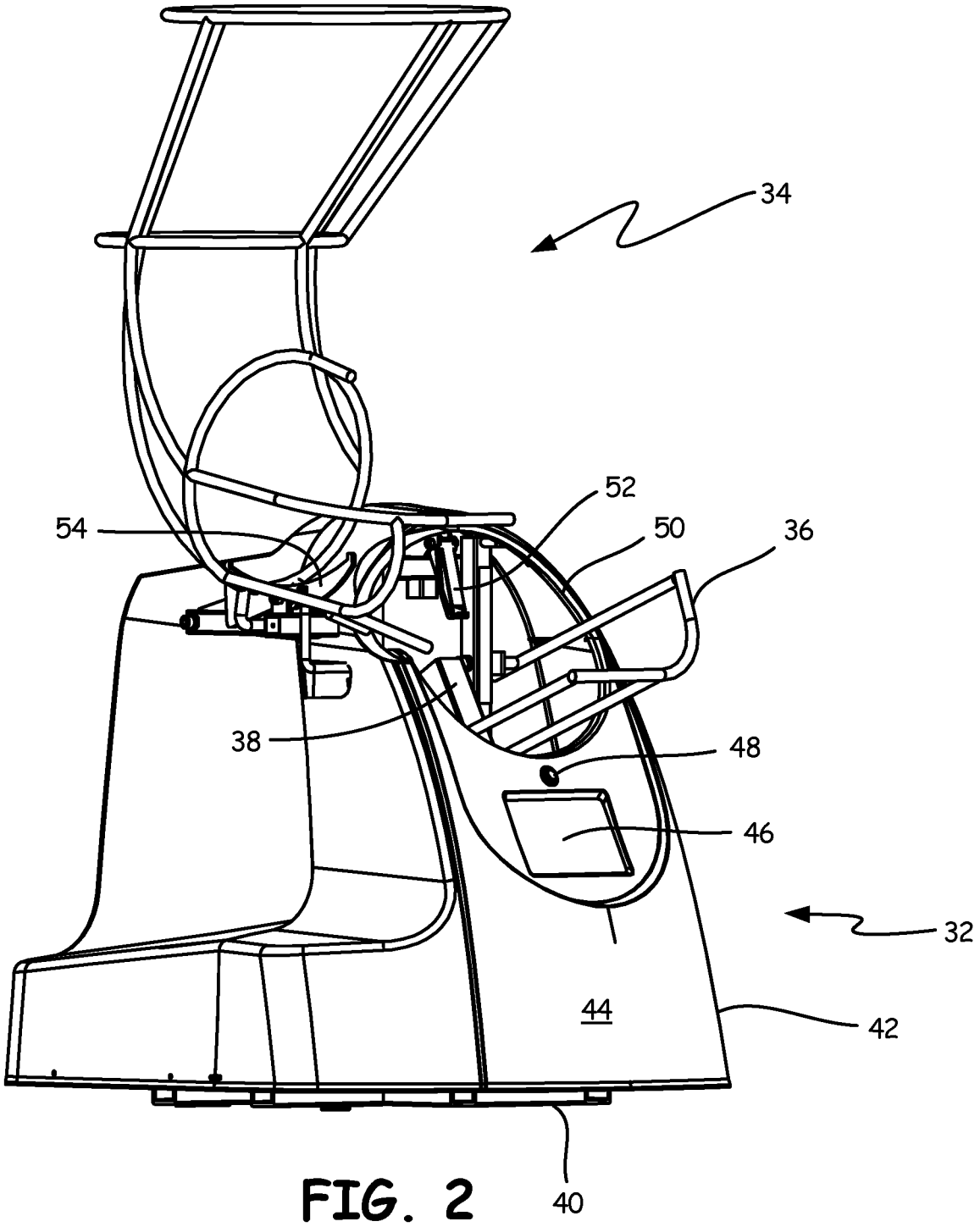
FIG. 2 is a front perspective view of the ball delivery system of FIG. 1.

FIG. 2 is a perspective view of ball delivery system 14 from the front and left of ball delivery machine 32. In this view, ball collection system 12 is not shown. Ball delivery system 14 includes ball delivery machine 32, to which main ball feeder 34 and ball ready holder 36 are mounted. Ball delivery machine 32 includes launch arm 38, bottom platform 40 (which is pivotably mounted to base 20 of ball collection system 12), and outer shell 42 (which encloses the ball launching mechanism and controls that operate machine 32). Front face 44 of outer shell 42 includes electronic front display 46, pre-launch warning light 48 and front opening 50. Also shown in FIG. 2 are ball ready lever 52 and toggle arm 54.

Balls that are collected by ball collection system 12 enter the upper end of main ball feeder 34 and are directed downward and forward to toggle arm 54, which stops further ball movement. When toggle arm 54 is actuated, it pivots to release a single ball to travel further downward and forward into ball ready holder 36. As shown in FIG. 2, ball ready holder 36 slopes downward and rearward through opening 50 into ball delivery machine 32. As the ball rolls down ball ready holder 36 toward launch arm 38, it contacts ball ready lever 52. When ball ready lever 52 is depressed by a ball in ball ready holder 36, it provides a ball ready input signal to the control system of ball delivery machine 32. The ball ready input signal received by the control system causes the control system to initiate a motor driven cycle in which launch arm 38 is engaged and pulled backward while a tension spring is extended. As the cycle continues, launch arm 38 is released and the spring force drives launch arm 38 forward to hit the ball and launch it forward out of ball delivery machine 32 and ball ready holder 36.

Rotation of ball delivery machine 32 relative to base 20 is driven by a gear motor responsive to commands from the control system of ball delivery machine 32 that causes bottom platform 40 to rotate relative to base 20 to cause ball delivery machine 32 to deliver balls, in sequence, to selected ball delivery locations. A direction of rotational movement of bottom platform 40 relative to base 20 is determined and managed by the control system based on an angular distance between sequentially-consecutive ball delivery locations.

In certain examples, one or more portions of ball delivery machine 32 can rotate along a vertical axis of ball delivery machine 32 (i.e., tilt) to adjust a vertical trajectory (i.e., exit angle) of balls delivered out of ball delivery machine 32 and ball ready holder 36. For instance, launching mechanisms of ball delivery machine 32 (e.g., including launch arm 38 and ball ready holder 36) can be pivotally mounted to tilt within ball delivery machine 32 relative to the vertical axis of ball delivery machine 32. Trajectories of delivered balls can be controlled (e.g., via tilt commands from a control system) to account for a distance between ball delivery machine 32 and a selected ball delivery location. For instance, a higher trajectory having a larger arc (e.g., a larger vertical angle of exit trajectory with respect to a horizontal axis extending along base 40) can be determined (and ball delivery machine 32 vertically rotated to provide such trajectory) for longer distances between ball delivery machine 32 and a selected ball delivery location. Similarly, a lower trajectory having a smaller arc (e.g., a smaller vertical angle of exit trajectory with respect to the horizontal axis extending along base 40) can be determined for shorter distances between ball delivery machine 32 and a selected ball delivery location. The trajectory can be determined based on both the ball delivery speed and a selected ball delivery height. As such, ball delivery machine 32 can control ball delivery speed in conjunction with the trajectory of ball delivery to deliver balls to account for varying distances between different selected ball delivery locations and a position of ball delivery machine 32.

In certain examples, a trajectory (i.e., exit angle) of balls launched from ball delivery machine 32 can be determined (or user selected) to account for user height. For instance, a higher trajectory having a larger exit angle with respect to the horizontal axis extending along base 40 (or the ground) can be selected to deliver balls to, e.g., taller users to enable such users to catch the ball at an elevation that is between the user's waist and the user's head. Similarly, a lower trajectory having a smaller exit angle with respect to the horizontal axis can be selected to delivery balls to, e.g., shorter users to enable such users to catch the ball at an elevation that is between the shorter user's waist and head. In certain examples, the trajectory of balls launched from ball delivery machine 32 can be determined (or user selected) to provide a type of pass, such as a bounce pass configured to bounce the ball prior to reaching the ball delivery location, a lob pass configured to have a large arcing trajectory toward the ball delivery location, or other types of passes. Indications of user selected height and/or type of pass can be received at a user interface operatively connected to the controller, as is further described below.

Accordingly, ball delivery machine 32 can be controlled (e.g., by a control system) to pivot both horizontally to deliver balls to a plurality of selected ball delivery locations and vertically (i.e., tilt) to adjust the trajectory of the delivered balls. As such, ball delivery machine 32 can be automatically controlled to enable training of game-like scenarios where a user may receive passes at varying locations and distances on the court as well as varying types of passes (e.g., chest passes, bounce passes, lob passes, or other types of passes) and passes having varying delivery speeds and delivery elevations. Ball delivery machine 32, therefore, can help to better simulate such game-like scenarios than a ball delivery machine that is limited to, e.g., fixed trajectories and ball delivery speeds at predetermined ball delivery locations, such as at locations spaced around the three-point line.

Figure 3:
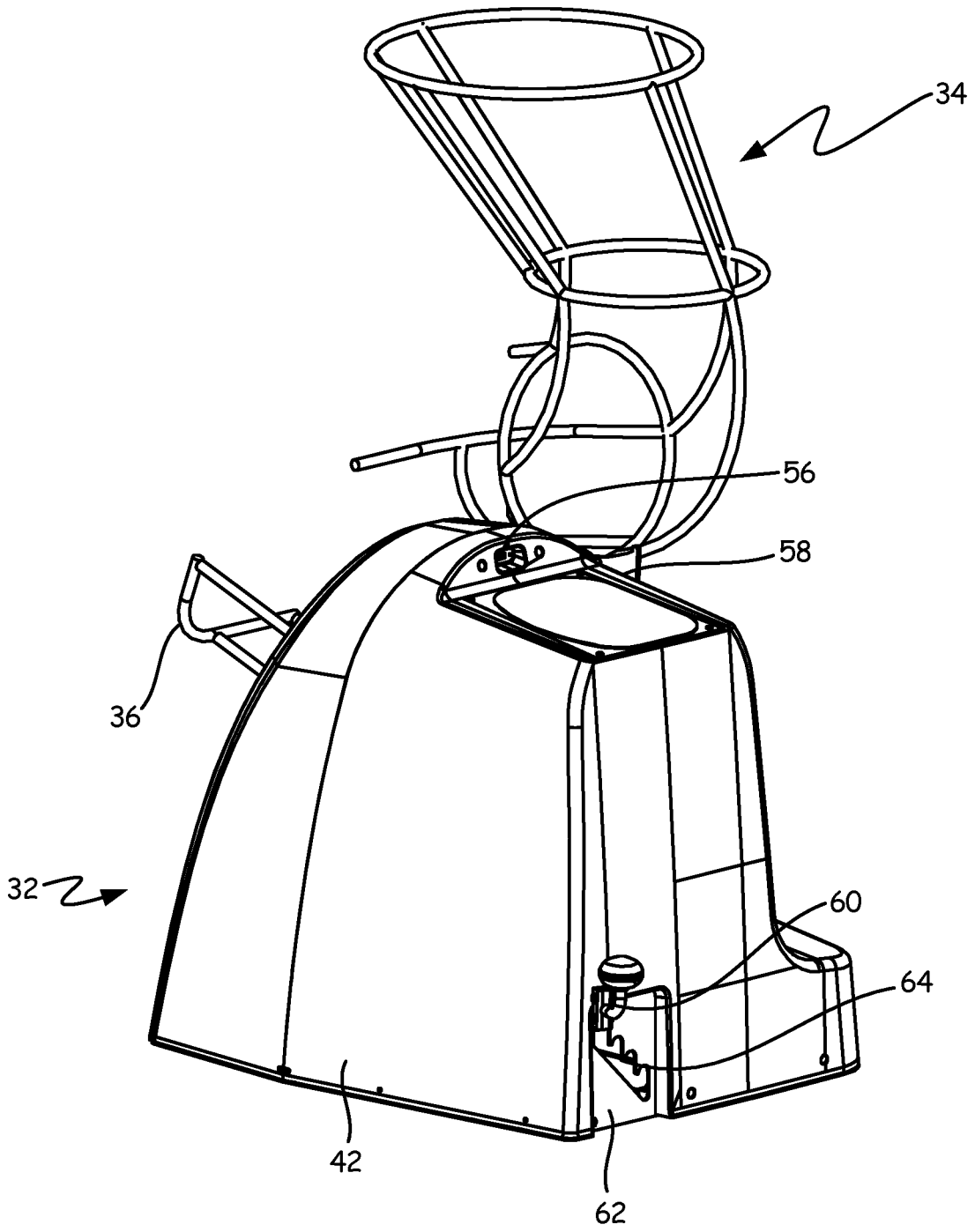
FIG. 3 is a rear perspective view of the ball delivery system of FIG. 1.

FIG. 3 is a perspective view of ball delivery system 14 from the rear and right of ball delivery machine 32. At the top of shell 42 are Universal Serial Bus (USB) port 56 and console 58, which allow a user to input information and select operating modes of ball delivery machine 32, and to receive outputs including data collected by machine as well as menus, instructions, and prompts. In some examples, ball delivery machine 32 may not include console 58 and/or USB port 56. Rather, in such examples, ball delivery machine 32 may receive and output information via a communication device (e.g., one or more wired and/or wireless transceivers) operatively coupled to one or more remote computing devices, such as mobile phones (including smartphones), personal digital assistants (PDAs), tablet computers, laptop computers, desktop computers, server systems, mainframes, or other remote computing devices.

As illustrated in FIG. 3, at the rear of ball delivery machine 32 are ball distance adjustment knob 60 and ball distance pre-select plate 62. Knob 60 and plate 62 are used, in some examples, to change the spring tension or preload on the spring that drives launch arm 38. The greater the preload, the further the distance the ball will be driven by launch arm 38 when it is released. In the embodiment shown in FIG. 3, plate 62 contains diagonal notched track 64, which includes five notches at which the tension rod connected to adjustment knob 60 can be positioned. The lower the position of knob 60, the greater the preload and the farther the ball will be launched.

In some examples, a delivery speed of balls driven by launch arm 38 (i.e., a speed at which launch arm 38 propels balls out of ball delivery machine 32) is set by a ball delivery speed adjustment actuator (shown in FIG. 4) controlled by the control system of ball delivery machine 32. For example, the ball delivery speed adjustment actuator can adjust a tension of the spring (or other tensioning element) that drives launch arm 38 forward to hit the ball and launch it forward out of ball delivery machine 32. In certain examples, the ball delivery speed adjustment actuator adjusts a drawback distance by which launch arm 38 is pulled backward to modify the spring tension utilized to propel launch arm 38 forward to hit the ball. In other examples, launch arm 38 is not propelled forward by a tensioning element, but rather is motor driven to propel launch arm 38 forward at a speed corresponding to a determined ball delivery speed.

The ball delivery speed can be determined by the control system based on a distance between ball delivery machine 32 and a ball delivery location. For example, the control system can determine a physical distance between ball delivery machine 32 and one or more selected ball delivery locations based on a relative distance between graphically-rendered locations of ball delivery machine 32 and the one or more selected ball delivery locations on a visual representation of at least a portion of a basketball court, as is further described below. The control system can determine the ball delivery speed based on (e.g., proportional to) the determined physical distances.

In some examples, the control system can modify the ball delivery speed for each selected ball delivery location. In other examples, the control system can determine the ball delivery speed for groups of selected ball delivery locations within threshold distances from ball delivery machine 32. In yet other examples, the control system can determine a single ball delivery speed based on an average of the distances between ball delivery machine 32 and each of the ball delivery locations, a maximum of the distances, a minimum of the distances, or other aggregations of the distances between ball delivery machine 32 and the selected ball delivery locations. In some examples, the control system may not modify the ball delivery speed. Rather, in such examples, the ball delivery speed may be manually adjusted via ball distance adjustment knob 60 (and ball distance pre-select plate 62).

Figure 4:
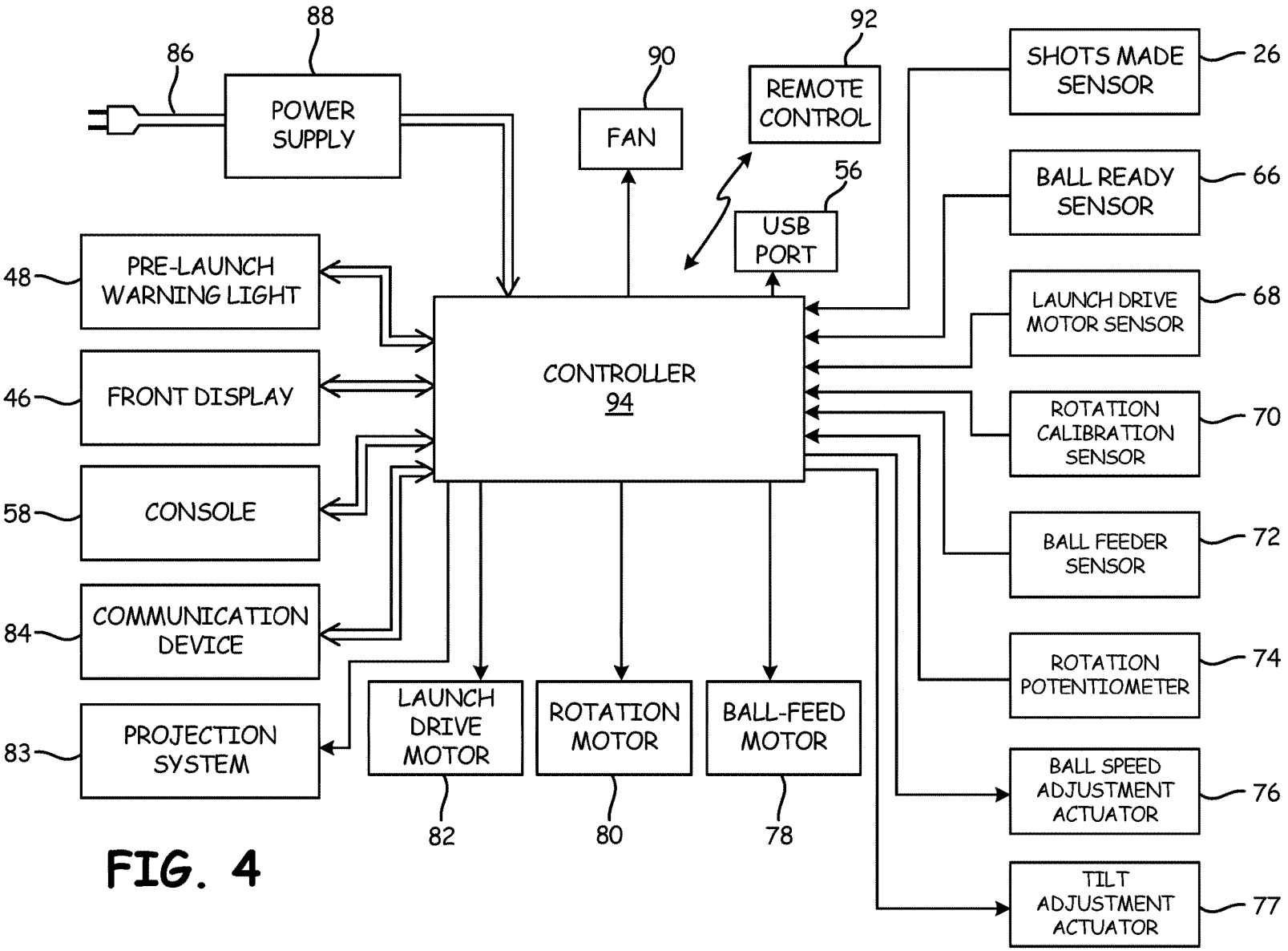
FIG. 4 is a block diagram of the control system of the ball delivery system.

FIG. 4 is a block diagram of the control system of the ball delivery system 14. Shown in FIG. 4 are shots made sensor 26, front display 46, pre-launch warning light 48, USB port 56, console 58, ball ready sensor 66, launch drive motor sensor 68, rotation calibration sensor 70, ball feed sensor 72, rotation potentiometer 74, ball speed adjustment actuator 76, tilt adjustment actuator 77, ball feeder toggle motor 78, rotation motor 80, launch drive motor 82, projection system 83, communication device 84, AC cable 86, power supply 88, fan 90, remote control 92, and controller 94.

Controller 94 is a processor-based controller that coordinates the operation of components of the control system. Controller 94 includes one or more processors and computer-readable memory encoded with instructions that, when executed by the one or more processors, cause controller 94 to operate in accordance with techniques described herein. Examples of one or more processors of controller 94 can include any one or more of a microprocessor, a controller, a digital signal processor (DSP), an application specific integrated circuit (ASIC), a field-programmable gate array (FPGA), or other equivalent discrete or integrated logic circuitry.

Computer-readable memory of controller 94 can be configured to store information within controller 94 during operation. Computer-readable memory of controller 94, in some examples, is described as computer-readable storage media. In some examples, a computer-readable storage medium can include a non-transitory medium. The term "non-transitory" can indicate that the storage medium is not embodied in a carrier wave or a propagated signal. In certain examples, a non-transitory storage medium can store data that can, over time, change (e.g., in RAM or cache). In some examples, the computer-readable memory is a temporary memory, meaning that a primary purpose of the computer-readable memory is not long-term storage. Computer-readable memory, in some examples, includes volatile memory that does not maintain stored contents when electrical power to controller 94 is removed. Examples of volatile memories can include random access memories (RAM), dynamic random access memories (DRAM), static random access memories (SRAM), and other forms of volatile memories. In some examples, computer-readable memory of controller 94 is used to store program instructions for execution by the one or more processors of controller 94. For instance, computer-readable memory of controller 94, in some examples, is used by software or applications running on controller 94 to temporarily store information during program execution.

Computer-readable memory of controller 94, in some examples, also includes one or more computer-readable storage media that can be configured to store larger amounts of information than volatile memory. In some examples, computer-readable memory of controller 94 includes non-volatile storage elements. Examples of such non-volatile storage elements can include magnetic hard discs, optical discs, floppy discs, flash memories, or forms of electrically programmable memories (EPROM) or electrically erasable and programmable (EEPROM) memories.

Sensors 26, 66, 68, and 72 are used by controller 94 in coordinating and controller the operation of motors 78, 80, 82, as well as ball speed adjustment actuator 76 and tilt adjustment actuator 77. Calibration sensors 70 are used by controller 94 during setup to provide calibration of the signal from potentiometer 74, which is used to determine the rotational position of ball delivery machine 32.

Controller 94 utilizes communication device(s) 84 to communicate with external devices via one or more wired or wireless communication networks, or both. Communication device(s) 84 can include any one or more communication devices, such as network interface cards (e.g., Ethernet cards), optical transceivers, radio frequency transceivers, Bluetooth transceivers, 3G or 4G transceivers, and WiFi radio computing devices.

In operation, controller 94 communicates with, e.g., a remote computing device to receive indications of positions of selected ball delivery locations, ball delivery timing (e.g., tempo) information, a number of balls delivered per location, a type of pass (e.g., chest pass, bounce pass, lob pass, or other type of pass), a selected ball delivery height, and position information of ball delivery machine 32 relative to a visual representation of at least a portion of a basketball court presented by a user interface executed by the remote computing device. As is further described below, controller 94 controls operation of components of the control system, such as ball speed adjustment actuator 76, tilt adjustment actuator 77, ball feeder toggle motor 78, rotation motor 80, and launch drive motor 82 to deliver balls to the selected ball delivery locations according to the received information. In certain examples, controller 94 controls operation of projection system 83 to project optical indications on the basketball court. For example, projection system 83 can include one or more light sources (e.g., LEDs, halogen or incandescent light bulbs, or other light sources) configured to be angularly controlled to emit visible light at locations and/or patterns on the basketball court. The one or more light sources can be colored light sources (or controllable to emit a determined light color). Controller 94 can control operation of projection system 83 to project optical indications, such as colored or uncolored light spots on the basketball court to visually indicate, e.g., one or more of a next selected ball delivery location, a next user shot location, or other indications, as is further described below.

As such, controller 94 controls operation of components of the control system of ball delivery machine 32 to deliver balls to selected ball delivery locations according to, e.g., user instructions received via a user interface that presents a visual representation of at least a portion of a basketball court that is free of indicia representing predetermined ball delivery locations on the basketball court, as is further described below.

Figure 5:
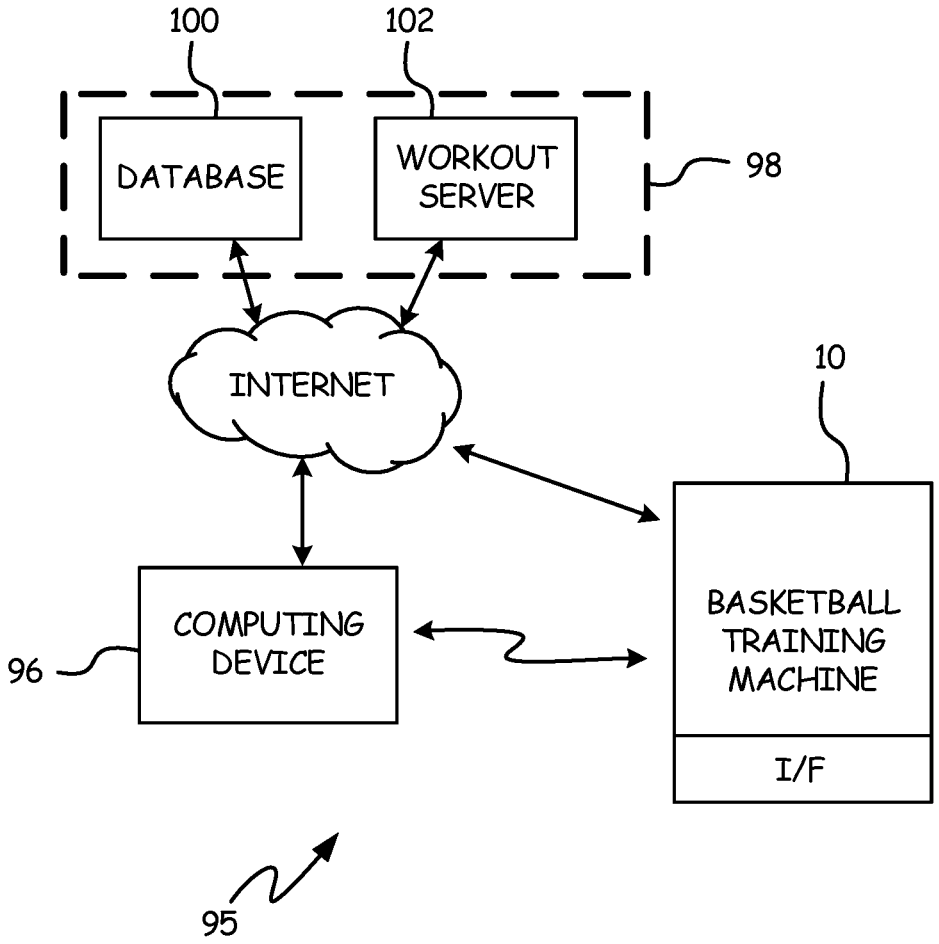
FIG. 5 is a block diagram of a basketball training system that includes the basketball training machine communicatively coupled with a computing device and a remote website.

FIG. 5 is a block diagram of basketball training system 95 that includes basketball training machine 10 communicatively coupled with computing device 96 and remote website 98. Website 98 includes database 100 and workout server 102.

As illustrated in FIG. 5, basketball training machine 10 is communicatively coupled with computing device 96. Computing device 96 includes one or more processors and computer-readable memory encoded with instructions that, when executed by the one or more processors, cause computing device 96 to output a graphical user interface for display at a display device and usable to select ball delivery locations and other workout information that is transmitted to basketball training machine 10 and/or website 98. Examples of computing device 96 include, but are not limited to, laptop computers, mobile phones (including smartphones), tablet computers, personal digital assistants (PDAs), desktop computers, or other computing devices.

Website 98, as illustrated in FIG. 5, includes (or implements) database 100 and workout server 102. Website 98 can be executed by a server system including one or more server devices accessible by computing device 96 and/or basketball training machine 10 via, e.g., the Internet or other communications network.

Computing device 96, as illustrated in the example of FIG. 5, is communicatively coupled with basketball training machine 10. For instance, computing device 96 and basketball training machine 10 can communicate directly using any one or more wired or wireless communication networks, such as a Bluetooth communication network, cellular communication network, local area network (LAN), wide area network (WAN), wireless LAN (WLAN), or other types of communication networks. In addition, each of basketball training machine 10 and computing device 96 are communicatively coupled to website 98 via one or more communication networks, such as the Internet. In some examples, rather than communicate directly, computing device 96 and basketball training machine 10 may communicate via website 98 or other communicative connection via the Internet. As such, computing device 96, basketball training machine 10, and the server system implementing website 98 need not be physically collocated, but can be in some examples.

While the example of FIG. 5 illustrates computing device 96 as separate from basketball training machine 10, in other examples, computing device 96 can be integral to or otherwise implemented by basketball training machine 10. For instance, basketball training machine 10 can include a touch-sensitive display device or other interface (illustrated as interface I/F) configured to output a graphical user interface that enables user interaction to control operational parameters of basketball training machine 10.

In one example operation, computing device 96 is a portable computing device, such as a mobile phone (e.g., smartphone), tablet computer, or other portable computing device including a touch-sensitive display device (commonly referred to as a touchscreen) that enables user interaction in the form of gesture input (e.g., single-finger tap gestures, multi-finger tap gestures, single-finger swipe gestures, multi-finger swipe gestures, pinch gestures using two or more fingers, or other gesture input). Computing device 96 outputs a graphical user interface that presents a visual representation of at least a portion of a basketball court and receives user gesture inputs relative to the visual representation that identify selected ball delivery locations desired by the user, as is further described below. Computing device 96 outputs indications of the selected ball delivery locations to one or more of basketball training machine 10 and website 98. Basketball training machine 10 delivers balls to the selected ball delivery locations according to the indications received from computing device 96. As such, basketball training system 95 enables user interaction via a graphical user interface to select ball delivery locations that are not limited (via indications or otherwise limited) to predetermined ball delivery locations. Moreover, the use of computing device 96 (which can be separate from basketball training machine 10) to present the graphical user interface can enable a coach, player, or other user to more easily and efficiently interact with basketball training machine 10, such as from a sideline of the basketball court or even a remote location to provide workouts, drills, and other training regimens.

Figure 6:
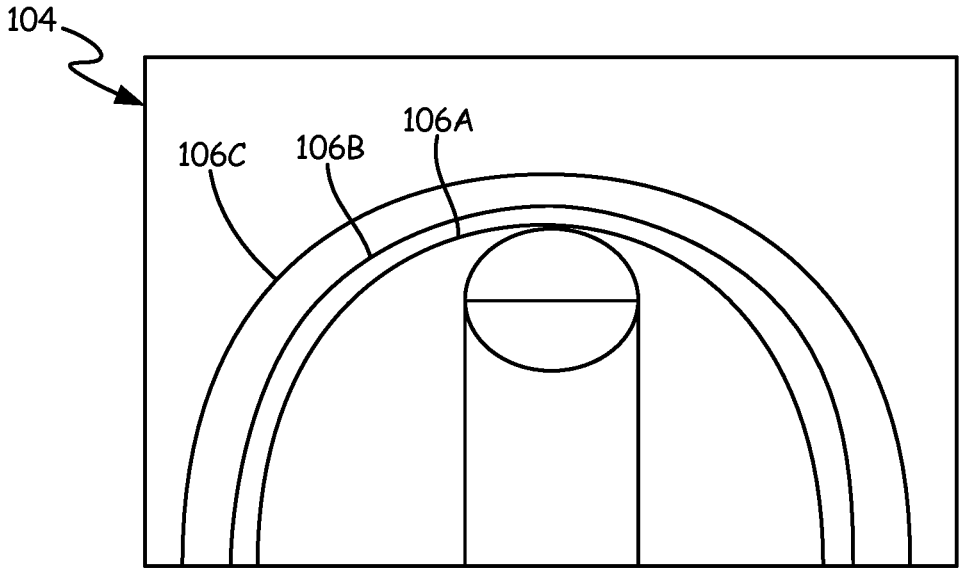
FIG. 6 is a conceptual diagram illustrating a portion of a graphical user interface that presents a visual representation of a portion of a basketball court that is free of indicia representing predetermined ball delivery locations.
Figure 7:
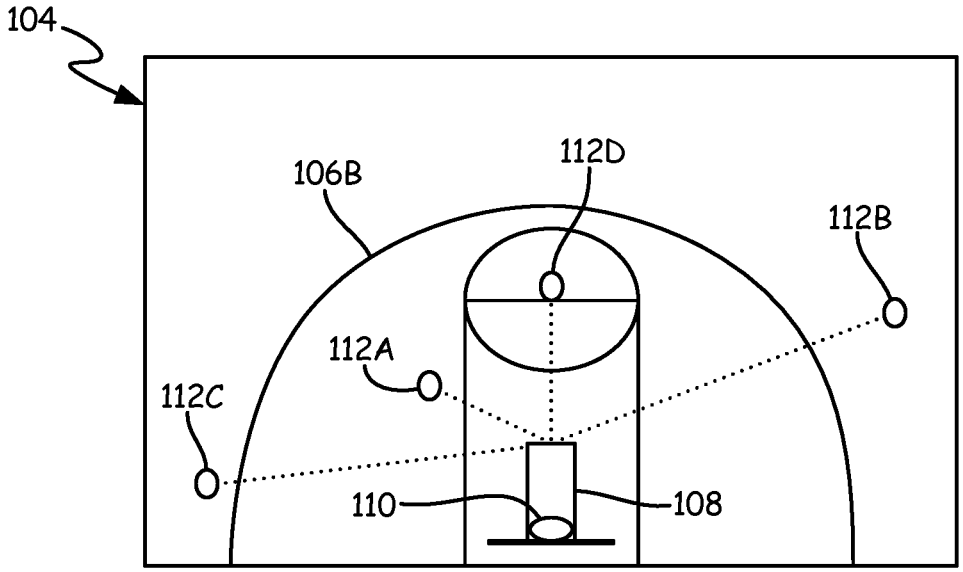
FIG. 7 is a conceptual diagram illustrating the portion of the graphical user interface displaying selected ball delivery locations with a graphical icon corresponding to the basketball training machine located underneath a basketball goal.
Figure 8A:
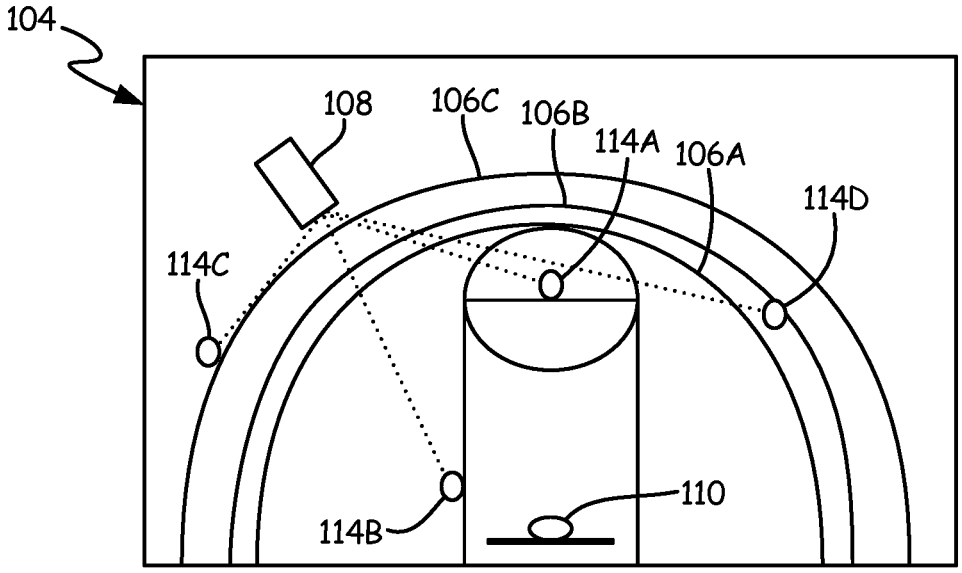
FIGS. 8A and 8B are conceptual diagrams illustrating the portion of the graphical user interface displaying selected ball delivery locations with the graphical icon corresponding to the basketball training machine located away from the basketball goal.
Figure 8B:
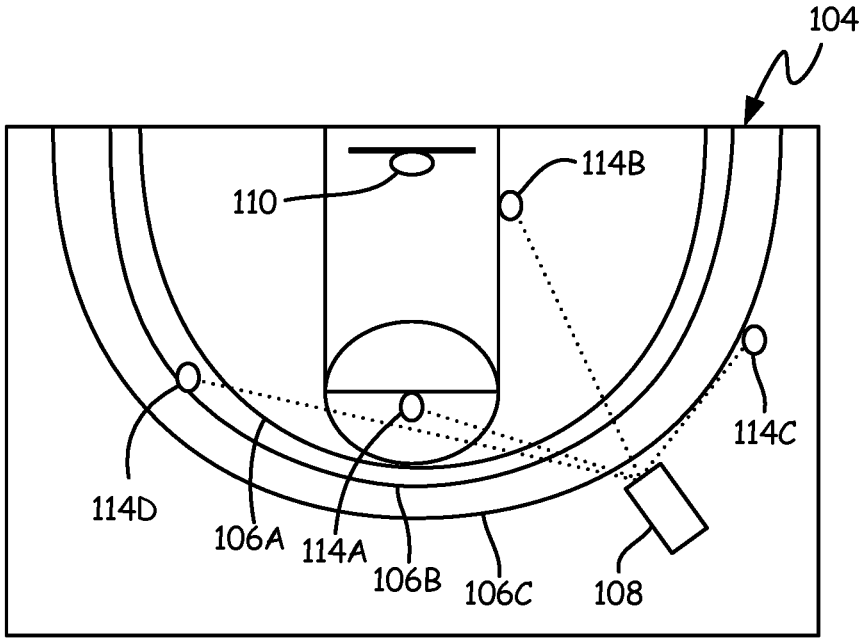

FIG. 6 is a conceptual diagram illustrating a portion 104 of a graphical user interface that presents a visual representation of a portion of a basketball court that is free of indicia representing predetermined ball delivery locations. FIG. 7 is a conceptual diagram illustrating portion 104 of the graphical user interface displaying selected ball delivery locations 112A-112D with graphical icon 108 corresponding to basketball training machine 10 located underneath a basketball goal. FIGS. 8A and 8B are conceptual diagrams illustrating differing orientations of portion 104 of the graphical user interface displaying selected ball delivery locations 114A-114D with graphical icon 108 corresponding to basketball training machine 10 located away from the basketball goal. For purposes of clarity and ease of discussion, the examples of FIGS. 6, 7, 8A, and 8B are described below within the context of basketball training system 95 of FIG. 5. While described below as outputting a visual representation of a portion of a basketball court having line markings corresponding to a standard North American basketball court, it should be understood that the graphical user interface can output a visual representation of other types of basketball courts (e.g., having line markings corresponding to standard European courts) or other playing surfaces (e.g., volleyball court, soccer field, or other types of playing surface).

As illustrated in FIG. 6, computing device 96 outputs portion 104 of a graphical user interface that presents a visual representation of a portion of a basketball court including three-point lines 106A, 106B, and 106C. Portion 104, as illustrated in FIG. 6, is free of indicia representing predetermined ball delivery locations, such as graphically-rendered or other visual markings, graphically-rendered or physical buttons, lights, or other physical or graphically-rendered indications representing predetermined ball delivery (or shot) locations. Accordingly, as is further described below, the portion 104 of the graphical user interface enables user interaction via gesture or other input (e.g., mouse, keyboard, voice command, or other user interaction input) relative to the visual representation of the portion of the basketball court to identify selected ball delivery locations without limiting such locations via predetermined indicia of location.

Three-point lines 106A, 106B, and 106C each represent boundaries on the visual representation of the portion of the basketball court separating two-point regions (between the basketball goal and the respective three-point line) from three-point regions (outside the interior of the respective three-point arc). Each of three-point lines 106A, 106B, and 106C represent three-point boundary lines traditionally used in high school competitions and younger (i.e., three-point line 106A), collegiate competitions (i.e., three-point line 106B), and professional competitions (i.e., three-point line 106C), though other three-point boundary lines or indications of point value bifurcations are possible.

Graphical presentation of any one or more of three-point lines 106A, 106B, and 106C can be user selectable via the graphical user interface. For instance, the graphical user interface can present one or more graphical control elements, such as checkboxes, dropdown menus, buttons, sliders, or other graphical control elements configured to allow user input to select the graphical rendering of any combination of three-point lines 106A, 106B, and 106C on the visual representation of the portion of the basketball court (including the graphical rendering of none of three-point lines 106A, 106B, and 106C). As an example, the graphical user interface can present graphical control elements in the form of three checkboxes, each corresponding to one of three-point lines 106A, 106B, and 106C and having a selectable attribute to cause the graphical user interface to display the corresponding one of three-point lines 106A, 106B, and 106C. As illustrated in FIG. 6, the graphical user interface presents each of three-point lines 106A, 106B, and 106C on the visual representation of the portion of the basketball court, though any combination (or none) of three-point lines 106A, 106B, and 106C can be displayed.

The graphical user interface and/or basketball training machine 10 utilize three-point lines 106A, 106B, and 106C to determine a point value corresponding to a made shot associated with a ball delivery location, as is further described below. In certain examples, the graphical user interface presents graphical control elements that enable user interaction to identify which of three-point lines 106A, 106B, and 106C is selected as bifurcating the three-point region from the two-point region for purposes of point value. For instance, the graphical user interface can present graphical control elements enabling user interaction to select the display of each of three-point lines 106A, 106B, and 106C, and to utilize, e.g., three-point line 106B as the active three-point line for purposes of allocating shot values.

Accordingly, the graphical user interface can enable user interaction to cause portion 104 of the graphical user interface to display any one or more of three-point lines 106A, 106B, and 106C and to utilize a selected one of three-point lines 106A, 106B, and 106C for purposes of shot value allocation.

In the illustrated example of FIG. 7, portion 104 of the graphical user interface displays selected ball delivery locations 112A, 112B, 112C, and 112D on the visual representation of the portion of the basketball court. In addition, portion 104 illustrates graphical icon 108 corresponding to basketball training machine 10 located beneath a basketball goal. Graphical icon 110, corresponding to shots made sensor 26, is displayed at a location corresponding to placement of shots made sensor 26 immediately below the basketball goal. In the example of FIG. 7, portion 104 displays three-point line 106B without displaying three point lines 106A and 106C (e.g., corresponding to user input selection to display and/or utilize three-point line 106B for shot value allocations).

Dotted lines extending from icon 108 illustrate delivery of balls from basketball training machine 10 to each of ball delivery locations 112A-112D, though the dotted lines may not be graphically rendered by portion 104 of the graphical user interface in some examples. In addition, it should be understood that, in operation, basketball training machine 10 rotates to deliver balls to each of ball delivery locations 112A-112D.

The group of ball delivery locations 112A-112D represents an ordered sequence of selected ball delivery locations. The ordered sequence can be user selectable and modifiable. For instance, the ordered sequence can correspond to user selection to deliver one or more basketballs first to ball delivery location 112A, second to ball delivery location 112B, third to ball delivery location 112C, and fourth to ball deliver location 112D. In general, the ordered sequence can correspond to any ordered sequence of ball delivery locations 112A-112D that can be selected by user input to identify the sequence. In some examples, the ordered sequence can include movement of icon 108 corresponding to ball delivery machine 32 (and the associated movement of ball delivery machine 32) between locations on portion 104 of the graphical user interface, such as between locations underneath the basketball and away from the basketball goal, between locations away from the basketball goal, or other movements of icon 108. While illustrated as including four selected ball delivery locations 112A-112D, in other examples, more or fewer than four ball delivery locations can be selected.

In operation, computing device 96 outputs an indication of the locations and sequence of selected ball delivery locations 112A-112D to basketball training machine 10 (i.e., to controller 94 via communication device 84), which delivers basketballs to the selected locations according to the ordered sequence. The indication of the locations can include, e.g., an indication of relative angles between each of selected ball delivery locations 112A-112D. In some examples, the indication of the locations can include a position of selected ball delivery locations 112A-112D with respect to the visual representation of the portion of the basketball court. In other examples, the indication of the locations can include a position of selected ball delivery locations 112A-112D with respect to the basketball court after scaling of the locations from a graphical scale (corresponding to the visual representation) to a physical scale (corresponding to the physical basketball court).

In some examples, computing device 96 can receive indications of the selected ball delivery locations in the form of a stored drill received from, e.g., workout server 102. For instance, the graphical user interface can present graphical control elements that enable user input (e.g., gesture input, mouse input, keyboard input, voice command input, or other user input) to select the stored drill. In response, computing device 96 can retrieve the stored drill information from workout server 102 accessed by computing device 96 via, e.g., the Internet. The stored drill can indicate the selected ball delivery locations, the sequence of the selected ball locations, tempo information corresponding to timing of the delivery of basketballs between the selected ball delivery locations, a number of basketballs to be delivered to each of the selected ball delivery locations, or other information corresponding to the stored drill. In some examples, the stored drill can indicate a location and/or orientation of the ball delivery machine, as is further described below.

Computing device 96 can receive indications of selected ball delivery locations 112A-112D via user selection input relative to the visual representation of the portion of the basketball court. For example, user selection input can include gesture input (e.g., tap gesture input, drag-and-drop gesture input, or other gesture input) relative to the visual representation of the portion of the basketball court received at a touchscreen display. In some examples, user selection input can include location selection input relative to the visual representation of the portion of the basketball court received via a mouse, keyboard, or other input device operatively coupled to computing device 96.

In certain examples, computing device 96 can receive (and display) indications of selected user shot locations independent from the indications of selected ball delivery locations. For instance, computing device 96 can receive indications of user selection input (e.g., tap gesture input, drag-and-drop gesture input, mouse input, keyboard input, or other user selection input) to select user shot locations corresponding to a selected ball delivery location. The selected user shot locations can indicate locations relative to the visual representation of the portion of the basketball court corresponding to a shot location that is different than a selected ball delivery location. The selected shot locations can correspond to user movement prior to receiving the basketball at a selected ball delivery location, after receiving the basketball at the selected ball delivery location, or both. For example, a user can receive a basketball at a selected ball delivery location and move (e.g., dribble) to the selected shot location corresponding to the selected ball delivery location to attempt the shot at the basketball goal. In other examples, the user can receive the basketball at the selected ball delivery location after specified player movement (e.g., specified and displayed via the graphical user interface) and can attempt the shot at the basketball goal from at or near the selected ball delivery location. In yet other examples, the user can receive the basketball at the selected ball delivery location after specified first movement and can attempt the shot at the basketball goal at a separate selected shot location after specified second movement from the selected ball delivery location. Computing device 96 and/or controller 94 of basketball training machine 10 can utilize selected user shot locations, rather than the selected ball delivery locations, for purposes of shot value allocations in examples where the selected shot location is specified as separate from the selected ball delivery location.

The ability to specify selected shot locations independent from selected ball delivery locations enables computing device 96 to attribute shot values and, in some examples, determine user analytics corresponding to the selected shot locations rather than merely the selected ball delivery locations. Such differentiation between selected shot locations and selected ball locations enables balls to be delivered to locations that are, e.g., in the three-point range (i.e., outside the selected three-point line) and to allocate shot values according to a selected shot location that is, e.g., in the two-point range (i.e., inside the selected three-point line). Similarly, balls can be delivered to locations within the two-point range while having a corresponding shot location that is within the three-point range, thereby enabling simulation of game-like user movement while allocating shot values (and tracking user analytics data) corresponding to the actual shot location that can be different than the selected ball delivery location. Moreover, the ability to incorporate user movement before and/or after receiving the basketball at the selected ball delivery location enables enhanced drill development that better simulates the game-like movement encountered by players in games, rather than requiring that shots be attempted from at or near the ball delivery location for purposes of shot value allocation and user analytics data (e.g., analytics corresponding to user shooting percentage from a location, while moving in a particular direction, from a particular side of the court, from a particular range on the court, or other analytics).

In some examples, portion 104 of the graphical user interface can display an indication of the selected player movement between selected ball delivery locations and corresponding selected user shot locations. For instance, portion 104 of the graphical user interface can display an arrowed line, a dotted or dashed line, a shaded or colored curvilinear path, an animated path, or other graphical indication of the selected player movements. Indications of the selected ball delivery locations and the selected user shot locations can be differentiated by, e.g., a color of the indication, a shading of the indication, a shape of the indication, or other differentiations. In certain examples, controller 94 can coordinate operation of projection system 83 to project an indication of selected ball delivery locations and/or selected user shot locations on the physical basketball court. For example, controller 94 can control operation of projection system 83 to project an optical indication (e.g., a spot of light) corresponding to a next selected ball delivery location, thereby providing visual guidance to the user of a next location to which balls will be delivered. As another example, controller 94 can control operation of projection system 83 to project a first optical indication (e.g., a first spot of light) corresponding to a selected ball delivery location and a second optical indication corresponding to a selected user shot location. The first and second optical indications can be simultaneously displayed and visually differentiable via, e.g., color, size, shape, or other differentiations. For instance, controller 94 can cause projection system 83 to output a red spot of light at a selected ball delivery location and a green spot of light at a selected user shot location corresponding to the selected ball delivery location, thereby providing visual guidance to a user regarding the location of a next ball delivery as well as a shot location to which the user is to move to attempt the shot. In yet other examples, controller 94 can cause a speaker or other audio system to output an audible indication of a next ball delivery location and/or selected user shot location (e.g., the audible words "left post", "right free-throw elbow", or other audible indications). Accordingly, controller 94 can coordinate operation of ball delivery machine 32 to guide a user through a drill including multiple ball delivery and shot locations from various locations of the court.

In certain examples, the graphical user interface can present graphical control elements that enable user input to select one or more player maneuvers associated with selected player movement between selected ball delivery locations and corresponding selected user shot locations. Examples of selected player maneuvers can include pump fakes, jab steps, crossover dribbles, behind the back dribbles, two dribble pullups, three dribble pullups, or other player maneuvers to be performed prior to or simultaneously with player movement between a selected ball delivery location and a corresponding selected user shot location. Portion 104 of the graphical user interface can display an indication of the selected player maneuvers, such as by displaying textual descriptions of the maneuvers, graphical icons representing the maneuvers, animations of the maneuvers, or other indications of the selected player maneuvers.

The ordered sequence of selected ball delivery locations 112A-112D can be determined, in some examples, according to a sequence by which user selection input is received to select ball delivery locations 112A-112D. For instance, a user can select ball delivery locations 112A-112D in the ordered sequence by first selecting ball delivery location 112A, second selecting ball delivery location 112B, third selecting ball delivery location 112C, and fourth selecting ball delivery location 112D. In some examples, the graphical user interface can present graphical control elements in the form of numbered icons that can be controlled via, e.g., drag-and-drop gesture input to identify the ordered sequence of selected ball delivery locations. For instance, a user can provide gesture input to move the numbered icons (e.g., via drag-and-drop gesture input) to locations relative to the visual representation of the portion of the basketball court to identify both the order and location of selected ball delivery locations (e.g., by moving a first numbered icon to a first ball delivery location corresponding to a first location in the ordered sequence, moving a second numbered icon to a second ball delivery location corresponding to a second location in the ordered sequence, etc.) In some examples, the user can provide gesture input to move the numbered icons to previously-selected ball delivery locations to identify the ordered sequence of the selected ball delivery locations.

In certain examples, the graphical user interface can provide one or more graphical control elements that enable user input to reorder the ordered sequence of selected ball delivery locations 112A-112D. For example, the graphical user interface can provide graphical control elements that enable user input to move a selected ball delivery location to a particular position in the ordered sequence (e.g., first, second, third, fourth, etc.) In some examples, the graphical user interface can provide graphical control elements that enable user input to move a selected ball delivery location relative to a current position of the selected ball delivery location within the ordered sequence (e.g., forward or backward a selected number of places within the ordered sequence). In some examples, the graphical user interface can provide graphical control elements that enable user input to delete and/or insert one or more selected ball delivery locations within the ordered sequence of selected ball delivery locations 112A-112D.

Computing device 96 can output an indication of the ordered sequence of selected ball delivery locations 112A-112D at portion 104 of the graphical user interface. For example, computing device 96 can output a numerical value corresponding to the ordered sequence at each of selected ball delivery locations 112A-112D (e.g., the number 1 at or near ball delivery location 112A, the number 2 at or near ball delivery location 112B, the number 3 at or near ball delivery location 112C, and the number 4 at or near ball delivery location 112D). In certain examples, basketball training machine 10 outputs an indication of a location of a next selected ball delivery location to which a basketball is to be delivered, such as at front display 46 or via a wired or wireless speaker of basketball training machine 10.

The graphical user interface can provide one or more graphical control elements that enable user input (e.g., gesture input, mouse input, keyboard input, or other user input) to select a number of basketballs to be delivered to each of selected ball delivery locations 112A-112D, a tempo (or relative timing) between delivered basketballs, a shots made goal, a time duration goal, a shots attempted goal, a consecutive shots made goal, a total number of points made goal, or other goal associated any one or more of selected ball delivery locations 112A-112D (i.e., to be met before basketballs are delivered to a sequentially next one of selected ball delivery locations 112A-112D), or other information corresponding to selected ball delivery locations 112A-112D.

Accordingly, the graphical user interface (including portion 104) enables user interaction to select ball delivery locations relative to the visual representation of the portion of the basketball court to identify selected ball delivery locations that are not limited in location by indicia of predetermined shot locations. As such, basketball training system 95 implementing the graphical user interface can enable user input to more effectively simulate the level of movement required of the shooter and the variety of shot locations frequently encountered in game conditions to enhance the training experience. Moreover, the graphical user interface and corresponding operation of basketball training system 95 described herein enables a user to attempt shots from both two-point and three-point ranges (and associated shot value allocations to be tracked), to attempt shots both before and after specified player movement, and to receive varying types of passes (e.g., bounce passes, chest passes, lob passes, or other types of passes) at varying ball delivery speeds that can be designated by the user and/or automatically determined by controller 94 based on a distance between ball delivery machine 32 and selected ball delivery locations. The techniques can therefore provide a dramatically enhanced training experience (as compared to a system that limits ball delivery locations to predefined locations and ball delivery speeds to a single, or manually selected speed) that better simulates game-like scenarios and accommodates drills that can be specifically targeted to a player's developmental needs.

FIGS. 8A and 8B illustrate differing orientations of portion 104 of the graphical user interface displaying selected ball delivery locations 114A, 114B, 114C, and 114D on the visual representation of the portion of the basketball court. That is, FIG. 8A illustrates a first orientation of portion 104 corresponding to a first viewer perspective of the portion of the basketball court from a location nearest to beneath the basketball goal. FIG. 8B illustrates a second (opposite) orientation of portion 104 corresponding to a second viewer perspective of the portion of the basketball court from a location nearest to mid court. The displayed orientation of portion 104 can be selectable (e.g., via graphical control elements presented by the graphical user interface) to enable user selection based on which orientation is easier for the user to understand. In certain examples, more than two display orientations of portion 104 can be presented for user selection, such as an orientation corresponding to a user perspective from a right side of the court, an orientation corresponding to a user perspective from a left side of the court, or other display orientations.

As further illustrated in FIGS. 8A and 8B, portion 104 illustrates graphical icon 108 corresponding to basketball training machine 10 located away from the basketball goal. In some examples, basketball training machine 10 can be positioned on the basketball court away from the basketball goal without ball collection system 12 (i.e., including only ball delivery system 14). In such examples, a non-shooting user can feed ball delivery system 14 with additional basketballs to enable drills requiring more basketballs than can be held within main ball feeder 34 of ball delivery system 14. In other examples, basketball training machine 10 can be positioned on the basketball court away from the basketball goal with ball collection system 12 attached, such that the shooting user can rebound shots and deliver (e.g., throw) them to ball collection system 12 for collection and resupply to ball delivery system 14.

As further illustrated in FIGS. 8A and 8B, portion 104 of the graphical user interface displays graphical icon 110 corresponding to shots made sensor 26 (which can be wirelessly connected with basketball training machine 10) at a location corresponding to placement of shots made sensor 26 immediately below the basketball goal. Portion 104, in this example, displays each of three-point lines 106A, 106B, and 106C, though user input can be received to select one of three-point lines 106A-106C as an active three-point line for purposes of shot value allocation by controller 94 of basketball training machine 10.

Graphical icon 108, in the examples of FIGS. 8A and 8B, illustrates a location and orientation of basketball training machine 10 when positioned away from the basketball goal. In some examples, graphical icon 108 can be user selectable to adjust (i.e., modify) the orientation of icon 108 to match an orientation of basketball training machine 10 on the basketball court. In such examples, a user can rotate icon 108 with respect to the visual representation of the portion of the basketball court to match the orientation of basketball training machine 10 as it is physically oriented on the basketball court, or can physically rotate basketball training machine 10 on the basketball court to match the orientation of icon 108 relative to the visual representation of the portion of the basketball court. In other examples, icon 108 can be preset to orient in a predetermined direction or toward a predetermined location of the visual representation of the portion of the basketball court. For instance, icon 108 can be preset to orient toward the basketball goal as user input is received to modify the location of icon 108 relative to the visual representation of the portion of the basketball court. In such examples, a user can physically orient basketball training machine 10 in the predetermined direction or toward the predetermined location (e.g., basketball goal) of the basketball court.

Computing device 96, in some examples, transmits an indication of the orientation and location of icon 108 to basketball training machine 10, which utilizes the location and orientation information to coordinate operation of components of basketball training machine 10 to deliver basketballs to selected ball delivery locations 114A-114D. In other examples, computing device 96 transmits to basketball training machine 10 position information of selected ball delivery locations 114A-114D relative to icon 108. In such examples, basketball training machine 10 can deliver basketballs to selected ball delivery locations 114A-114D based on the relative position information without knowledge of absolute position of icon 108 with respect to the visual representation of the portion of the basketball court. As such, rather than require a user to mentally translate the location and orientation of icon 108 relative to predetermined ball delivery locations when basketball training machine 10 is located away from the basketball goal, basketball training system 95 implementing techniques described herein can enable a user to select ball delivery locations relative to a graphically-rendered icon having an orientation and location corresponding to a physical location and orientation of basketball training machine 10. That is, the ability to place icon 108 on portion 104 relative to the visual representation of the portion of the basketball court such that icon 108 matches both a location and orientation of ball delivery machine 32 on the physical basketball court enables a user to more easily select ball delivery locations, user shot locations, or provide other input relative to icon 108 without requiring the user to mentally invert or transpose the orientation of icon 108 to match the position of ball delivery machine 32 as would be required if icon 108 could only be graphically rendered, e.g., under the basketball goal.

The techniques described herein enable a user (e.g., player, coach, or other user) to select desired ball delivery locations relative to a visual representation of a basketball court that are not limited by indications of predetermined ball delivery locations. Basketball training machine 10 can adjust a ball delivery speed and/or trajectory of delivered balls to automatically adjust for varying distances between basketball training machine 10 and selected ball delivery locations, as well as differing types and/or elevations of passes at any one or more of the ball delivery locations. Moreover, the ability to position basketball training machine 10 away from the basketball goal and to easily select ball delivery locations (and, in some instances, separate user shot locations), specify player movement, player maneuvers, and identify goals associated with such locations can enable the user to better simulate game-like conditions where passes are most frequently received from a location other than beneath the basketball goal. This ability to better simulate game-like player movement as well as pass delivery and receipt locations at varying locations and distances from the basketball goal without limiting such locations via predefined indicia can increase an effectiveness of the time spent training to prepare the user to effectively respond to game-like conditions.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A basketball training system comprising:

a user interface that presents a visual representation of a portion of a basketball court that is free of indicia representing predetermined ball delivery locations on the basketball court, wherein the user interface displays a ball delivery machine location on the visual representation, and wherein the user interface is configured to receive user inputs relative to the visual representation that identify selected ball delivery locations desired by a user relative to the ball delivery machine location displayed on the visual representation, wherein the user interface comprises a touchscreen user interface, wherein the user inputs comprise user gesture inputs received at the touchscreen user interface, and wherein the selected ball delivery locations comprise an ordered sequence of ball delivery locations; and a ball delivery machine, responsive to the user interface, for delivering basketballs to physical locations corresponding to the selected ball delivery locations, wherein the ball delivery machine includes:

a controller in communication with the user interface, the controller comprising one or more processors and a computer-readable storage medium; and a ball launcher responsive to the controller, wherein the controller is configured to provide control commands to the ball launcher to cause the ball launcher to launch basketballs from the ball delivery machine to the physical locations corresponding to the selected ball delivery locations according to the selected ball delivery locations that were received relative to the ball delivery machine location displayed on the visual representation, and wherein the ball delivery machine is configured to deliver the basketballs to the physical locations corresponding to the selected ball delivery locations according to the ordered sequence;

a ball in play sensor configured to indicate when one or more basketballs are delivered by the ball launcher; and a shot made sensor configured to indicate when one or more basketball shots are successfully made.

2. The basketball training system of claim 1, wherein the user interface is configured to receive user inputs that identify the ball delivery machine location with respect to the visual representation of the portion of the basketball court.

3. The basketball training system of claim 1 wherein the user interface is configured to present graphical control elements that enable user input to reorder the ordered sequence of ball delivery locations.

4. The basketball training system of claim 1, wherein in response to user input that selects a stored drill, the user interface is configured to display on the visual representation of the portion of the basketball court the ball delivery machine location and selected ball delivery locations associated with the selected stored drill.

5. The basketball training system of claim 1, wherein the user interface is configured to receive user inputs relative to the visual representation that identify selected shot locations that are separate from the selected ball delivery locations.

6. The basketball training system of claim 5, wherein the user interface is configured to display indications of user movement between the selected ball delivery locations and the selected shot locations.

7. The basketball training system of claim 5, wherein the user interface is configured to display indications of user maneuvers corresponding to user movement between the selected ball delivery locations and the selected shot locations.

8. The basketball training system of claim 7, wherein the user maneuvers comprise at least one of a pump fake, a jab step, a crossover dribble, a behind the back dribble, a two dribble pullup, and a three dribble pullup.

9. The basketball training system of claim 1, wherein the user gesture inputs comprise a drag-and-drop input.

10. The basketball training system of claim 1, wherein the user interface can present graphical control elements in the form of numbered icons that can be moved via a drag-and-drop input.

11. The basketball training system of claim 1, wherein the user gesture inputs comprise a tap gesture input.

12. The basketball training system of claim 1, wherein the visual representation presented by the user interface further includes indicia that does not represent predetermined ball delivery locations.

13. The basketball training system of claim 12, wherein the indicia that does not represent predetermined ball delivery locations comprises lines.

14. The basketball training system of claim 13, wherein the indicia that does not represent predetermined ball delivery locations comprises a free throw line and a three-point line.

15. A method comprising:

outputting, by a computing device for presentation at a display device, a user interface including a visual representation of at least a portion of a basketball court that is free of indicia representing predetermined ball delivery locations on the basketball court, wherein the visual representation of at least the portion of the basketball court that is free of indicia representing predetermined ball delivery locations is presented on a touch-sensitive display device, wherein the user interface displays a ball delivery machine location on the visual representation;

receiving, by the computing device, an indication of user inputs relative to the ball delivery machine location on the visual representation that identify selected ball delivery locations, wherein receiving the indication of the user inputs relative to the ball delivery machine location on the visual representation that identify the selected ball delivery locations comprises receiving the indication of the user inputs as an ordered sequence of ball delivery locations, wherein the indication of user inputs is received on the touch-sensitive display device, and wherein the computing device drives the touch-sensitive display device to display the selected ball delivery locations relative to the ball delivery machine location on the visual representation of at least the portion of the basketball court that is free of indicia representing predetermined ball delivery locations in response to receiving the indication of user inputs relative to the ball delivery machine location on the visual representation that identify selected ball delivery locations; and outputting, by the computing device, the selected ball delivery locations to a controller of a ball delivery machine configured to deliver basketballs from the ball delivery machine toward physical locations corresponding to each of the selected ball delivery locations, wherein the ball delivery machine comprises a ball launcher responsive to the controller;

providing, by the controller, control commands to the ball launcher to cause the ball launcher to launch the basketballs from the ball delivery machine to the physical locations corresponding to the selected ball delivery locations according to the selected ball delivery locations that were received relative to the ball delivery machine location displayed on the visual representation; and launching, by the ball launcher, the basketballs in the directions responsive to the control commands.

16. The method of claim 15, further comprising:

receiving, by the computing device, an indication of user inputs relative to the visual representation of the portion of the basketball court that identify the location of the ball delivery machine.

17. The method of claim 15, further comprising:

receiving, by the computing device via the user interface, an indication of user inputs to select a stored drill; and outputting, by the computing device in response to receiving the indication of the user inputs to select the stored drill, the ball delivery machine location and selected ball delivery locations associated with the selected stored drill for presentation at the display device via the user interface.

18. The method of claim 15, further comprising:

receiving, by the computing device, an indication of user inputs relative to the visual representation that identify selected shot locations that are separate from the selected ball delivery locations.

19. The method of claim 18, further comprising:

outputting, by the computing device for presentation at the display device, indications of user movement between the selected ball delivery locations and the selected shot locations.

20. The method of claim 18, further comprising:

outputting, by the computing device for presentation at the display device, indications of user maneuvers corresponding to user movement between the selected ball delivery locations and the selected shot locations.

21. A basketball training system comprising:

a ball delivery machine having a ball launcher;

a user interface comprising a display, wherein the user interface comprises a touchscreen user interface;

one or more processors;

a computer-readable storage medium coupled to the one or more processors having instructions stored thereon which, when executed by the one or more processors, cause the one or more processors to perform operations comprising:

presenting, on the display of the user interface, a visual representation of a portion of a basketball court that is free of indicia representing predetermined ball delivery locations on the basketball court;

detecting user inputs on the user interface that identify selected ball delivery locations relative to the visual representation of the portion of the basketball court that is free of indicia representing predetermined ball delivery locations on the basketball court, wherein the user inputs are received relative to a ball delivery machine location displayed on the visual representation, wherein the selected ball delivery locations comprise an ordered sequence of ball delivery locations;

providing control commands to the ball launcher of the ball delivery machine to cause the ball launcher to launch basketballs in directions from the ball delivery machine to physical locations corresponding to the selected ball delivery locations according to the selected ball delivery locations that were received relative to the ball delivery machine location displayed on the visual representation; and in response to detecting the user inputs on the user interface that identify new selected ball delivery locations, controlling the ball delivery machine to deliver basketballs to the new selected ball delivery locations, wherein the ball delivery machine is configured to deliver the basketballs to the selected ball delivery locations according to the ordered sequence;

a ball in play sensor that is configured to indicate when one or more basketballs are delivered by the ball launcher; and a shot made sensor that is configured to indicate when one or more basketball shots are successfully made.

22. The basketball training system of claim 21, wherein the operations further comprise:

detecting user inputs on the user interface that identify of the ball delivery machine location relative to the visual representation of the portion of the basketball court that is free of indicia representing predetermined ball delivery locations on the basketball court.

23. The basketball training system of claim 21, wherein the operations further comprise:

detecting user inputs on the user interface that identify selected shot locations relative to the visual representation of the portion of the basketball court that is free of indicia representing predetermined ball delivery locations on the basketball court, wherein the selected shot locations are separate from the selected ball delivery locations.

24. The basketball training system of claim 21, wherein the user gesture inputs comprise a drag-and-drop input, wherein the user interface can present graphical control elements in the form of numbered icons, wherein the visual representation presented by the user interface further includes indicia that does not represent predetermined ball delivery locations, and wherein the indicia that does not represent predetermined ball delivery locations comprises lines.

25. The basketball training system of claim 21, wherein the visual representation presented on the display of the user interface further includes indicia that does not represent predetermined ball delivery locations, wherein the indicia that does not represent predetermined ball delivery locations comprises lines.

26. The basketball training system of claim 21, wherein the operations further comprise:

presenting graphical control elements that enable a user to execute a drag-and-drop input to move one or more numbered icons to new selected basketball delivery locations relative to the visual representation of the portion of the basketball court.

* * * * *